United States Patent [19]

Heidt-Cizerle

[11] 4,392,571

[45] Jul. 12, 1983

[54] DEVICE FOR DISPLAYING AND MARKING FOODS OR THE LIKE

[76] Inventor: Trude-Helga Heidt-Cizerle, Bertholdstrasse 17, D7518 Bretten 1, Fed. Rep. of Germany

[21] Appl. No.: 319,965

[22] Filed: Nov. 10, 1981

Related U.S. Application Data

[63] Continuation of Ser. No. 129,891, Mar. 13, 1980, abandoned.

[30] Foreign Application Priority Data

Mar. 17, 1979 [DE] Fed. Rep. of Germany ..... 2910649

[51] Int. Cl.[3] ..... B65D 1/34

[52] U.S. Cl. ..... 206/557; 206/804; 294/27 R

[58] Field of Search ..... 220/23.83, 94 R, 95, 220/1.5; 206/557, 804; 294/27 R, 27 H, 32, 87.2, 87.28, 27

[56] References Cited

U.S. PATENT DOCUMENTS

| | | | |
|---|---|---|---|
| 1,625,154 | 4/1927 | Rand | 40/10 D |
| 2,612,401 | 9/1952 | Simmonds | 294/27 R |
| 2,905,502 | 9/1959 | Brown | 294/27 R X |
| 3,194,429 | 7/1965 | Bouet | 220/95 X |
| 3,463,344 | 8/1969 | Temple | 294/27 R X |
| 3,520,570 | 7/1970 | Christopher et al. | 294/27 R |
| 3,760,996 | 9/1973 | Campbell | 220/23.83 |
| 4,023,702 | 5/1977 | McKnight | 220/94 R |

*Primary Examiner*—Steven M. Pollard

*Attorney, Agent, or Firm*—Thomas W. Speckman

[57] ABSTRACT

A device for displaying and marking articles such as foods or the like, on a holder, such as a tray, board, dish, bowl, or the like, characterized by the holder being held in place in and removable from a carrier support adjusted to it, the carrier support having firmly attached to it at least one handle extending over the holder with a marking plate connected or connectable to it.

16 Claims, 5 Drawing Figures

DEVICE FOR DISPLAYING AND MARKING FOODS OR THE LIKE

This is a continuation of application Ser. No. 129,891, filed Mar. 13, 1980, now abandoned.

BACKGROUND OF THE INVENTION

1. Field of the Invention

This invention relates to a device for displaying and marking foods or the like which are on a tray, board, dish, bowl, or the like, such as on counters in eating establishments, shop counters, or the like.

2. Description of the Prior Art

For counters in eating establishments, shop counters or the like, very different kinds of holders for articles, such as trays, boards, dishes, bowls, or the like, are used for displaying and marking foods. The marking plates with the written or printed carriers are frequently inserted directly into the foods. However, these marking plates are no longer permitted for reasons of hygiene.

As DE-GM (German Registered Design) No. 19 56 821 shows, there exist also card holders which can be put on the edge of a tray. However, these card holders, as before, come in contact with the foods deposited on the tray. Moreover, the card holders attached in this manner can be inspected only with great difficulty.

It is an object of the invention to develop a device for displaying and marking foods or the like where an easily visible marking plate is attached and is certain not to come in contact with the deposited foods.

In the present invention, this is achieved by the fact that the holder, such as the tray, the board, the dish, the bowl, or the like, is held immovable and portable in a carrier support which is adjustable to it; that on the carrier support there is firmly attached a handle extending over the tray, the board, the dish, the bowl, or the like; and that a marking plate is connected or connectable to the handle.

The use of a carrier support of this kind adjusted to the tray, the board, the dish, the bowl, or the like, has also the advantage that the tray, the board, the dish, the bowl, or the like, can be held by the handle and carried. This facilitates the depositing and the removing of the tray, the board, the dish, the bowl, or the like, from a counter. The tray, the board, the dish, the bowl, or the like, however, can be taken off the carrier support at any time. This is of special advantage for cleaning.

The immovable anchoring of a tray on the carrier support is, according to one embodiment, achieved by providing the tray with a surrounding horizontal edge and the carrier support is a frame which is bent from round material and adjusted to the contour of the tray below the edge.

The placing of deposit on the tray, the board, the dish, the bowl, or the like is, according to one embodiment, not impaired by the handle because of the fact that on a narrow side of the frame there is attached a strip-like handle which extends first vertical to the frame and due to a rounding goes over into an end portion which forms an acute angle with the plane of the frame. The depositing of foods is then performed unhindered over the two broad sides of the tray.

The design of the carrier support has been carried out in a most simple manner in such a way that the frame is weleded together from a portion of a metal bar and that the handle of sheet metal is welded to the frame.

If a board is used for depositing foods, the layout is preferably such that the carrier support for the board is designed as a frame which comprises L-shaped parts and is adjusted to the outside contour of the board—with the frame covering, at least partly, the bottom side and the side faces of the board. The board is held immovable and portable in the frame formed in this manner.

The attaching of a handle on the carrier support of this type has been solved according to one embodiment in such a way that a strip-like handle is connected with its vertical side to a narrow side of the carrier support.

In order not to obstruct too much of the access to the surface of deposit from the narrow side having the handle, one embodiment provides that the handle be attached in the center of the narrow side of the frame of the carrier support.

In order to be able to clean the carrier support having the handle, it is provided in another embodiment that the carrier support and the handle be provided with a finishing surface, such as chromium.

According to another embodiment it is provided that the marking plate be designed as a pocket for a card which can be written on or printed on and whose front side is transparent. As needed, the marking plate can hold differently written or printed cards in case the price of the displayed food changes.

According to a preferred embodiment it is provided that the marking plate has an insert holder on the back side by means of which it can be put on the end edge of the strip-like handle. The marking plate can be removed easily from the handle when the carrier support with the handle is cleaned. The elements for this removable insert connection are easily obtained by the fact that the insert holder is formed by two clamping bars arranged at a distance which are formed onto the back side of the marking plate which is made of elastic synthetic material.

BRIEF DESCRIPTION OF THE DRAWINGS

Preferred embodiments of the invention are explained in detail by means of different embodiments illustrated in the drawings wherein:

FIG. 1A shows another embodiment of connection of a handle to the carrier support shown in FIG. 1;

FIG. 3A shows another embodiment wherein the carrier support and handle are bent from a single portion of a round bar;

DESCRIPTION OF THE PREFERRED EMBODIMENTS

Figure 1:
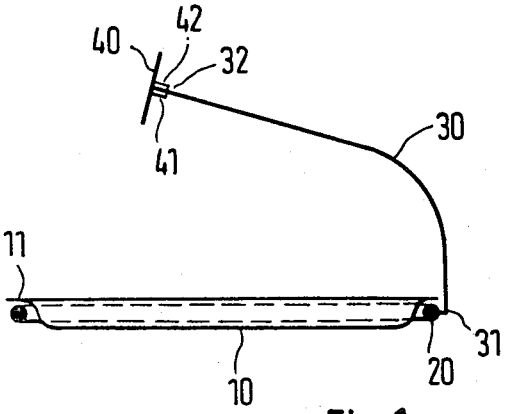
FIG. 1 shows a side view of the device according to one embodiment of the invention adapted to a tray, with a sectional drawing of the carrier support.
Figure 2:
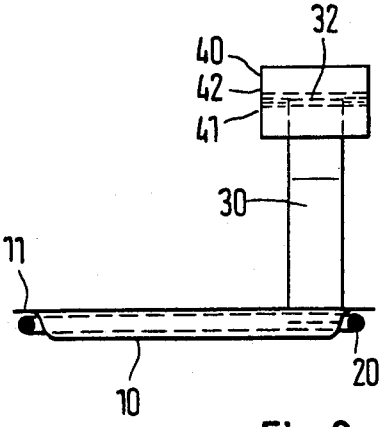
FIG. 2 shows the device according to FIG. 1, looking at the narrow side of the tray where the handle is arranged at one end of the narrow side.
Figure 3:
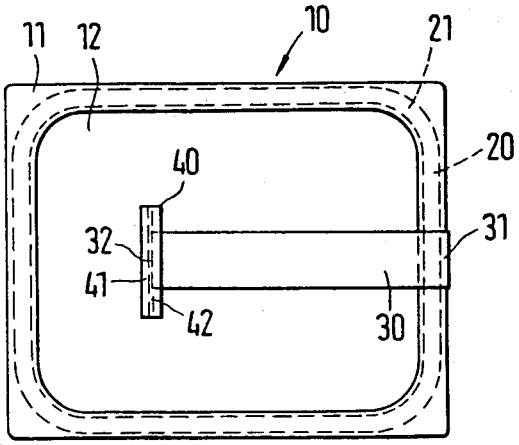
FIG. 3 shows a top view of the device according to FIG. 1 where the handle is arranged in the center of the narrow side.

For the device according to FIGS. 1 to 3, commercial trays 11 are used for depositing foods. The trays 10 have a horizontal surrounding edge 11 and form a tub-shaped flat receptacle 12. The carrier support 20 is bent as a frame from a portion of a round metal bar and welded together. As the rounded corners 21 also show, the frame is here adjusted to the contour of the tray 10 below the edge 11 so that it can hold the tray 10 in immovable fashion. As the connection spot 31 shows, a strip-like handle 30 of sheet metal is connected, preferably welded, to the frame of the carrier support 20. Handle 30 extends first vertically and is then bent over the frame by way of a rounding. The end portion of handle 30 extends over the tray deposited in the frame and leaves sufficient space for depositing foods on the tray 10. The end portion of the handle 30 forms here, preferably, an acute angle with the plane of the frame. The frame and handle 30 form one unit which, for reasons of hygiene, is provided with a finishing layer, for instance, a chromium layer. Handle 30 can be gripped easily from the upper side and thereby the carrier support 20 with the tray 10 and the foods deposited on it can be carried.

As FIGS. 2 and 3 show, at least one handle 30 can be attached in the corner zone of a narrow side or in the center of a narrow side of the frame of carrier support 20. This depends on the depositing position of the device on the counter as well as on the desired access to the foods deposited on tray 10.

On the free end edge 32 of the handle 30 there is put a marking plate 40 of synthetic material. Marking plate 40 has formed onto its back side two clamping bars 41 and 42 which are at a distance from each other than corresponds to the thickness of the strip-like handle 30. In this manner the marking plate 40 is easily removable from the handle 30. This is especially important for the cleaning of the unit consisting of the carrier support 20 and the handle 30. The marking plate 40 is designed as a pocket whole front side is transparent and can hold card carriers on which one can write or print. In this manner the marking data can be changed easily and adjusted to new facts.

Figure 4:
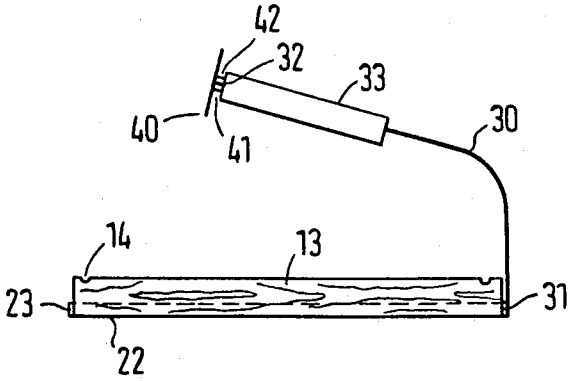
FIG. 4 shows a side view of a device according to another embodiment of the invention adapted to a board.
Figure 5:
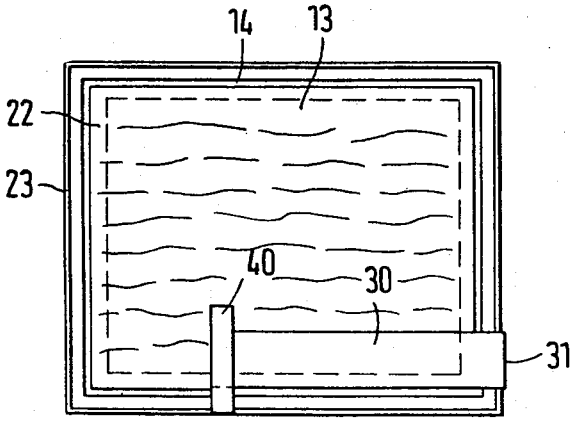
FIG. 5 shows a top view of the device according to FIG. 4 having a differently formed and differently designed handle.

In the embodiment according to FIGS. 3 and 4, the foods are deposited on a board 13 which is provided with a surrounding groove 14 in the edge zone on the upper side. The carrier support 22 is designed as a frame which consists of L-shaped parts. This frame reaches partly under the bottom side of the board 13 and partly covers its side faces with the vertical sides 23. The board 13 is thereby held in place and removable from the frame of the carrier support 22. As the connection spot 32 shows, the strip-like handle 30 is connected with the vertical side 23 of the frame on a narrow side. Here the handle 30 can again be arranged selectively in the corner zone or in the center of said narrow side.

As FIG. 4 shows, the end portion of the handle 30 can be provided additionally with a handle element 33 which has a larger cross section and facilitates the grabbing of the handle 30.

It goes without saying that the frame-like construction of the carrier support can also be adjusted to other contours, for instance, for holders such as dishes, bowls or the like. In each case, the carrier support gives sufficient support to the holders for the foods so that they can be carried by the handle. The handle, too, can be designed differently. Thus, it is clearly within the framework of the present invention to connect the frame of the carrier support 10 according to FIGS. 1 to 3 with a handle made as a portion of a round rod. With a sufficiently large cross section, the frame and the handle can also be bent from a single portion of a round rod as shown in FIG. 3A.

So that the device as defined in the invention can be packed and stored in a space saving manner, it is provided according to another embodiment that the handle is removably connected with the carrier support 20 or 22 as shown in FIG. 1A. Here it has proven to be of advantage if the handle is connected with a locking element 33 that can lock the handle on the carrier support.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. Device for displaying and marking articles such as foods or the like comprising a flat rectangular tray (10) having a horizontally extending edge (11), and provided with a holder for receiving said tray, said holder having a carrying handle, characterized in that said holder (20, 22) is constructed in the shape of a flat rectangular frame which forms a receptacle for depositing said tray (10) with said edge resting on said rectangular frame; that said frame has the same cross-sectional shape on all sides; that a handle member (30) is attached to one side of said frame and projects toward the opposite side of said frame over said tray (10), the distance of said handle member above said frame and tray increasing toward said opposite side, and that to the free end portion of said handle (30) a marking plate (40) is connected or connectable to said handle, said marking plate (40) positioned in a manner such that it can be viewed from the side of the frame opposite the side of said frame that has said handle (30) attached thereto.

2. Device as defined in claim 1 characterized by the fact that said frame consists of L-shaped parts which are adjusted to the outside contour of said tray with the frame at least partly covering the bottom side and the side faces of the tray.

3. Device as defined in claim 2 characterized by the fact that a strip-like handle (30) is connected with a vertical side (23) of a narrow side of said frame.

4. Device as defined in claim 1 characterized by the fact that the carrier support (20) is a frame bent of round material which is adjustable to the contour of the tray surrounding a tub-shaped depressed flat receptacle (12).

5. Device as defined in claim 4 characterized by the fact that on a narrow side of said frame there is attached a strip-like handle (30) which first extends vertical to the frame and by way of rounding goes over into an end portion which forms an acute angle with the plane of the frame.

6. Device as defined in claims 4 or 5 characterized by the fact that said frame is welded together from a portion of a metal rod and that the handle (30) of sheet metal is welded together with the frame.

7. Device as defined in claims 1, 4, 5, 6, 2 or 3 characterized by the fact that the handle (30) is attached in the center of the narrow side of the frame of the carrier support (20).

8. Device as defined in claim 1 characterized by the fact that the carrier support (20, 22) and the handle (30) are provided with a finishing layer.

9. Device as defined in claim 1 characterized by the fact that the marking plate (40) is designed as a pocket for a carrier to be written on or printed on whose front side is transparent.

10. Device as defined in claim 9 characterized by the fact that the marking plate (40) has an insert hold on the back side by means of which said plate can be put on the end edge (32) of the strip-like handle (30).

11. Device as defined in claim 10 characterized by the fact that the insert holder is formed by two clamping bars (41, 42) arranged at a distance from each other which are formed of the marking plate (40) made of elastic synthetic material.

12. Device as defined in claims 1, 4, 5, 6, 2 or 3 characterized by the fact that the handle is attached in the zone of a corner of a narrow side of the frame of the carrier support (22).

13. Device as defined in claim 1 characterized by the fact that in the end portion, which forms an acute angle with the plane of the frame, the handle (30) is provided with a handle element (33) which has a larger cross section.

14. Device as defined in claims 1 or 2 characterized by the fact that the frame of the carrier support (20) and the handle are bent from a single portion of a round bar.

15. Device as defined in claim 1 characterized by the fact that the handle is removably connected with the carrier support (20, 22).

16. Device as defined in claim 15 characterized by the fact that the handle is provided with a locking element which can be put on locking on the carrier support (20, 22).

* * * * *